United States Patent [19]

Grimm

[11] Patent Number: 4,881,839

[45] Date of Patent: Nov. 21, 1989

[54] PORTABLE ELECTRONIC DATA HANDLING/DATA ENTRY SYSTEM

[75] Inventor: Thomas R. Grimm, Troy, Tex.

[73] Assignee: Texas Instruments Incorporated, Dallas, Tex.

[21] Appl. No.: 206,640

[22] Filed: Jun. 14, 1988

[51] Int. Cl.[4] ..... B41J 29/02

[52] U.S. Cl. ..... 400/692; 400/693; 400/174

[58] Field of Search ..... 400/692, 693, 103, 174, 400/320, 120

[56] References Cited

U.S. PATENT DOCUMENTS

| | | | |
|---|---|---|---|
| 4,389,130 | 6/1983 | Giolitti | 400/175 X |
| 4,553,868 | 11/1985 | Crosio | 400/175 X |
| 4,613,244 | 9/1986 | Okabayashi et al. | 400/175 |
| 4,632,584 | 12/1986 | Becibi et al. | 400/320 X |
| 4,633,274 | 12/1986 | Matsuda | 400/175 X |
| 4,635,080 | 1/1987 | Watanabe | 400/175 X |
| 4,706,096 | 11/1987 | Sato | 400/103 |
| 4,734,710 | 3/1988 | Sato et al. | 400/692 X |
| 4,736,213 | 4/1988 | Piatt et al. | 400/175 X |
| 4,755,836 | 7/1988 | Ta et al. | 400/175 X |

FOREIGN PATENT DOCUMENTS

| | | | |
|---|---|---|---|
| 25476 | 3/1981 | Japan | 400/692 |
| 45980 | 3/1983 | Japan | 400/692 |
| 116157 | 7/1983 | Japan | 400/692 |
| 179270 | 9/1985 | Japan | 400/692 |
| 210480 | 10/1985 | Japan | 400/692 |

OTHER PUBLICATIONS

IBM Tech. Dis. Bulletin, "Bridge Assembly for Mounting Interchangeable Electromagnetic Devices", vol. 29, No. 9, Feb. 1987, pp. 4117–4118.

*Primary Examiner*—Edgar S. Burr
*Assistant Examiner*—James R. McDaniel
*Attorney, Agent, or Firm*—N. Rhys Merrett; James T. Comfort; Melvin Sharp

[57] ABSTRACT

An electronic terminal is mechanically and electrically connected to an electronic printer module to form a portable electronic terminal/printer. The bottom housing of the terminal and an extended portion of the bottom housing of the printer module together form a dovetail type connection. The bottom housing of the terminal has a plurality of rails formed thereon and the extended portion of the bottom housing of the printer module has a plurality of channels formed therein for slidably receiving the rails, forming a dovetail type connection. One half of an electrical connector is mounted on the terminal and the other half of the electrical connector is mounted on the printer module in a position to couple when the mechanical dovetail connection is made. A latch mechanism, attached to the extended portion of the bottom housing of the printer secures the bottom housing of the printer and also the two halves of the electrical connector. When the latch mechanism is activated, the electrical connection is broken and the mechanical connection is disengaged.

15 Claims, 4 Drawing Sheets

PORTABLE ELECTRONIC DATA HANDLING/DATA ENTRY SYSTEM

BACKGROUND OF THE INVENTION

1. Field of the Invention

This invention relates to electronic terminals and to electronic printers. More particularly, it relates to a mechanical and electrical coupling of a terminal and printer to form a portable unit.

2. Description of the Prior Art

In the past, it has been common practice to electrically couple printers to terminals.

It has also been common practice to mechanically couple printers to electronic calculators, with the electrical connection made by flexible wiring between connectors.

It has further been common practice to interconnect communication assemblies through mechanical connectors with electrical connections made via flexible wiring.

This invention requires no flexible wiring, achieving the electrical connection at the same time that the mechanical connection is made.

BRIEF SUMMARY OF THE INVENTION

An electronic terminal or computer is capable of being electrically and mechanically connected to another module such as a printer or a key pad or a combination of printer and key pad.

To activate all of the keys of the printer and/or key pad, and buses to other components,requires a large number of electrical signals and a correspondingly large number of electrical conductors. The electrical connection therefore between the terminal and the printer module requires a large number of contacts. In this preferred embodiment, a 140 pin-type connector is used. The pin side of the connector is mounted on the terminal with the receptacle mounted on the printer module. Registration of this complex connector is accomplished through the use of a dovetail type mechanical connection between the bottom housing of the terminal and an extended portion of the bottom housing of the printer module. The bottom housing of the terminal has a plurality of rails formed therein and the extended portion of the bottom housing of the printer module has a plurality of channels formed therein for slidably receiving the rails in forming the dovetail type connection. The rails and channels, of course, may be interchanged. As the terminal and printer modules are moved together through the dovetail type connection, the electrical connector halves are closely and automatically aligned so that the connector halves mate readily as the mechanical connection between the terminal and the printer moudle is completed.

A mechanical latching mechanism latches the terminal and the printer module, holding the mechanical and electrical connections in place. When these connections are to be broken, the latching mechanism provides a disengaging force to cause the electrical connector to separate and to release the mechanical connection.

The principal object of this invention is to provide an electrical terminal that is capable of having a printer module mechanically and electrically connected to it to form a portable electronic data handling/data entry system.

This and other objects of this invention will be made obvious in the detailed description that follows:

DETAILED DESCRIPTION OF THE INVENTION

Figure 1:
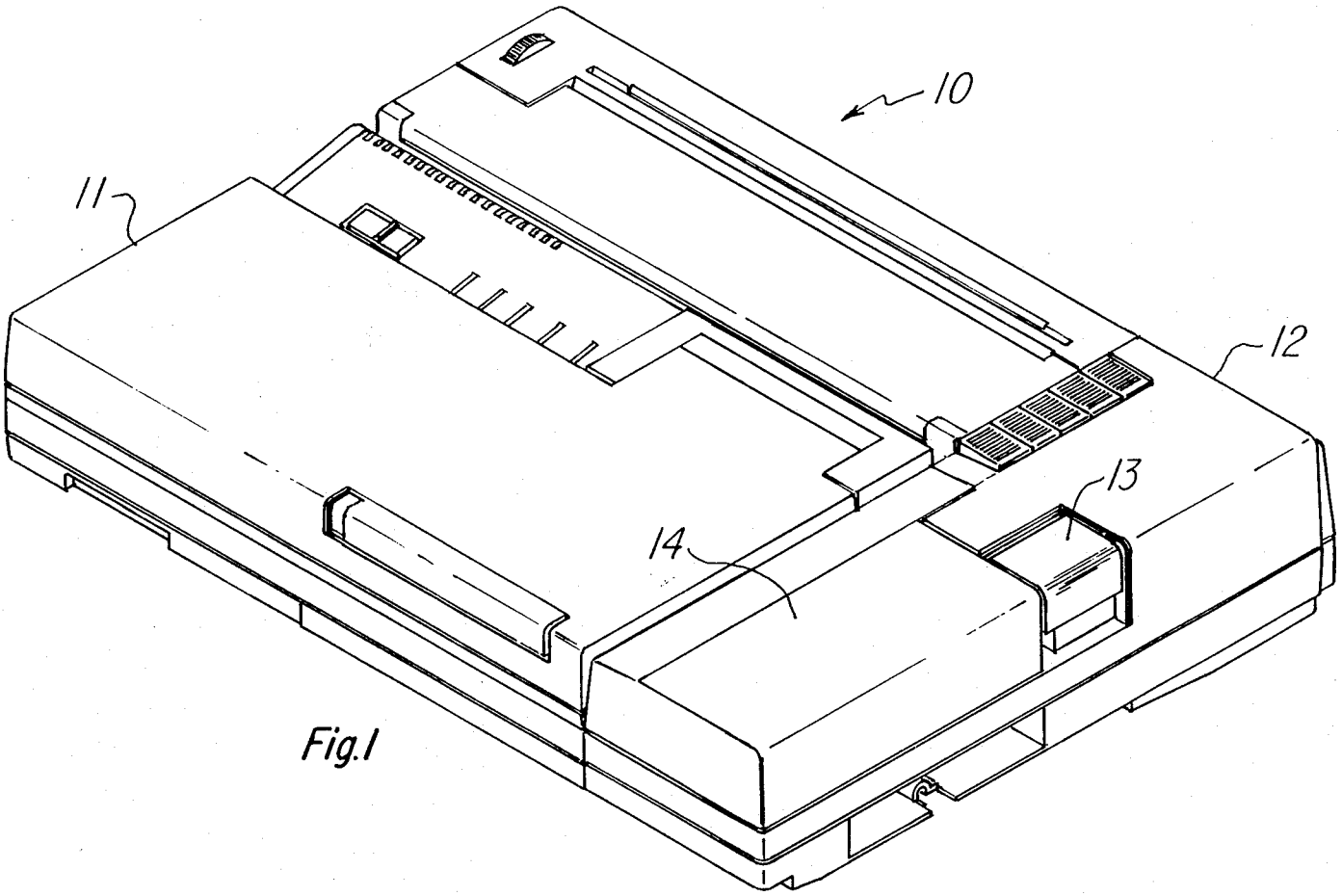
FIG. 1 is a perspective drawing of the portable electronic terminal/printer of this invention.

FIG. 1 illustrates portable electronic data handling-/data entry system 10 comprising terminal 11 and printer module 12. Printer module 12 has ejector button 13. Key pad assembly 14 is also shown. Key pad assembly 14 may be attached to terminal 12 without the printer. Also, the printer module may be attached without the key pad 14.

Figure 2:
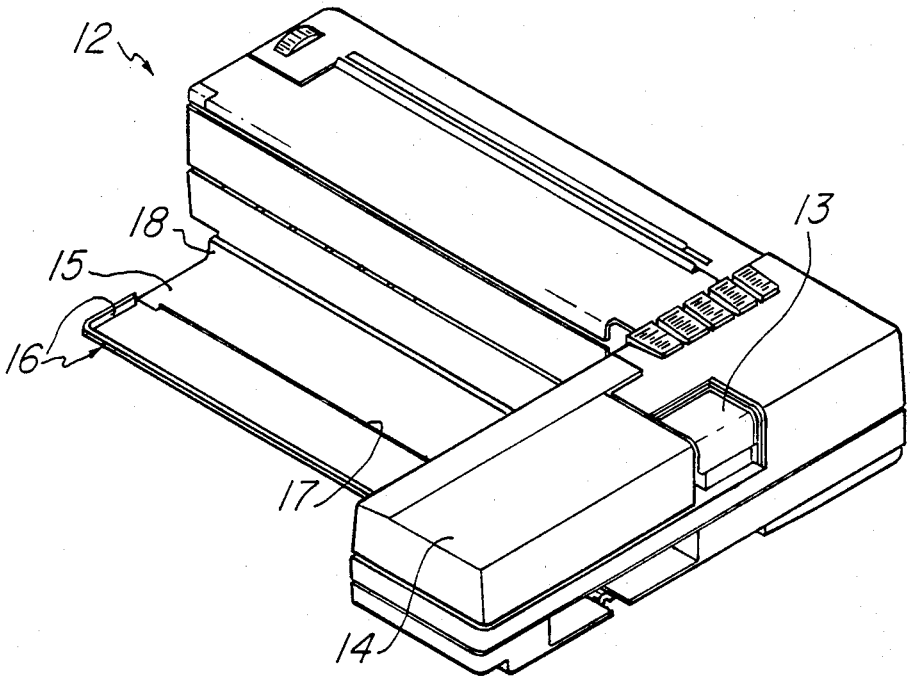
FIG. 2 is a perspective drawing of the printer module of this invention.

FIG. 2 illustrates the printer module 12 with extension 15 shown. Curved surface 18 of extension 15 provides a guide for the bottom housing of terminal 11. Channels 17 and 16 receive the rails formed on the bottom housing, to be described below.

Figure 3:
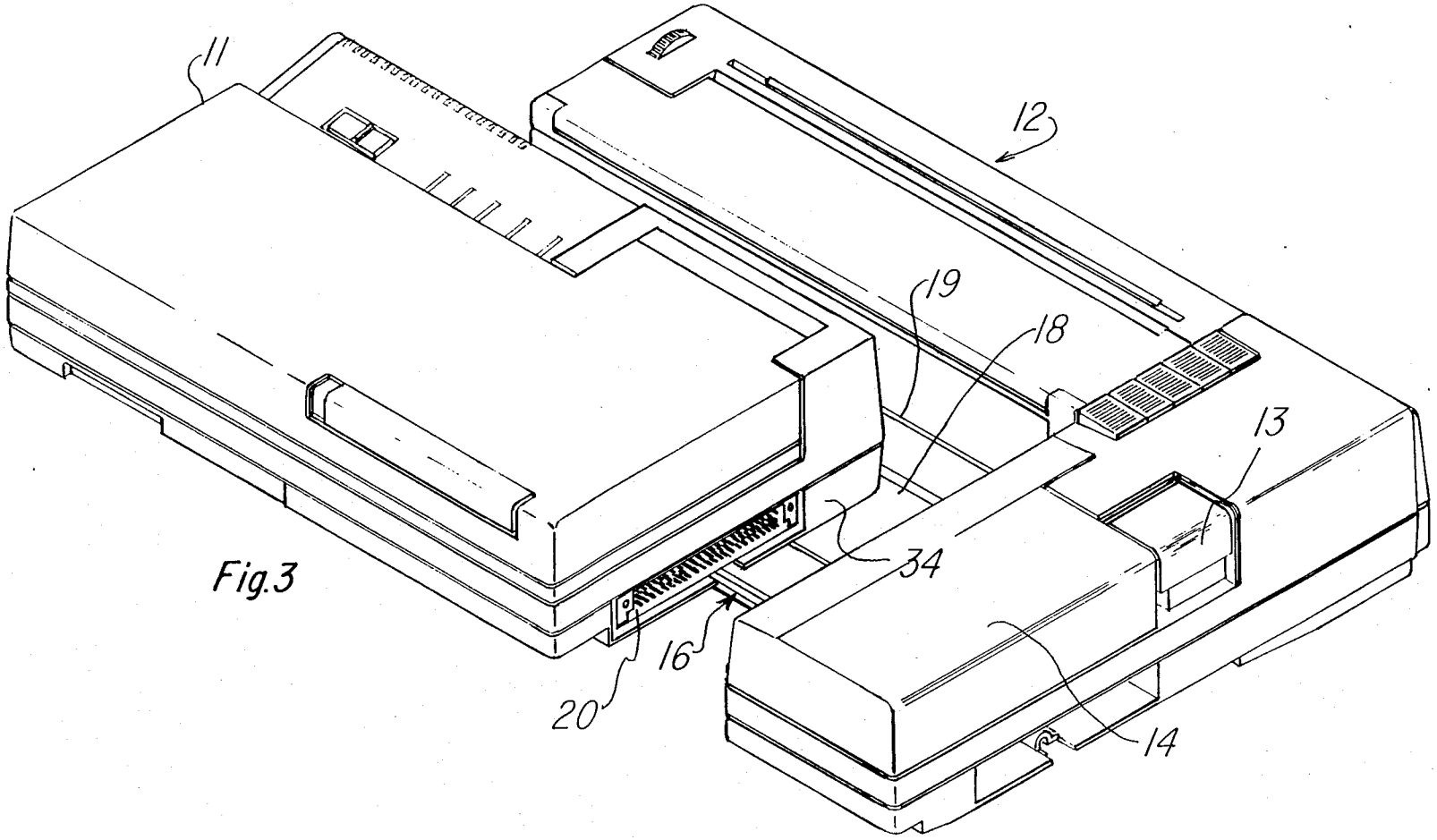
FIG. 3 is a perspective drawing of the terminal partially moved into locking position with the printer module.

FIG. 3 illustrates terminal 11 in place on extension 15 before mechanical and electrical connection to printer module 12. The male portion of electrical pin connector 20 is shown. The corresponding female portion of the connector, which is attached to printer module 12 is not shown. In this preferred embodiment, connector 20 has 140 pins.

Figure 4:
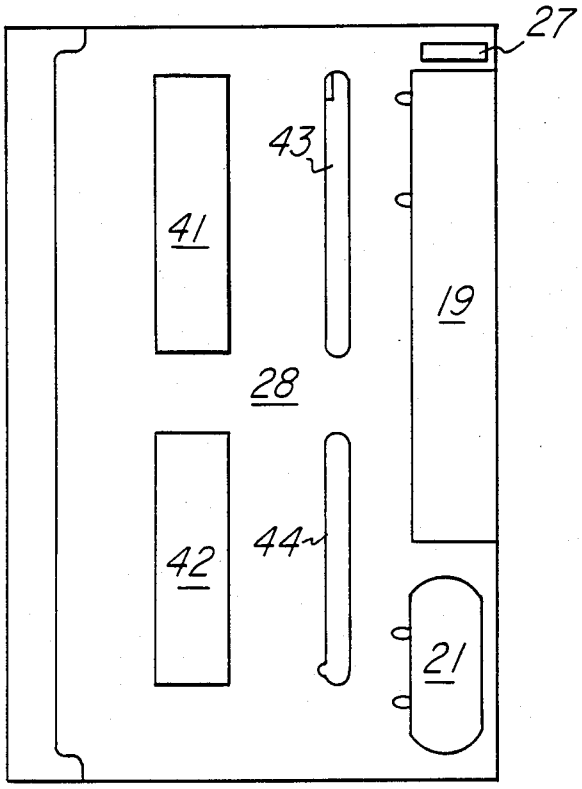
FIG. 4 is a drawing of the bottom housing of the terminal.

FIG. 4 shows the bottom housing 28 of terminal 11*e*. Rails 41 and 42 are shown as formed on housing 28. Rails 41 and 42 engage channel 16 shown in FIG. 2. Rails 43 and 44 shown formed on the bottom housing 28 engage channel 17 shown in FIG. 2. Covers 19 and 21 form curved surfaces for engaging curved surface 18 of extension 15 (see FIG. 2). These surfaces form self aligning guides for moving terminal 11 into mechanical connection with printer module 12 and also for the mating of the connector halves of the electrical connector 20. Latch bar 27 is shown formed on bottom housing 28 and is used for the mechanical connection between terminal 11 and printer module 12.

Figure 5A:
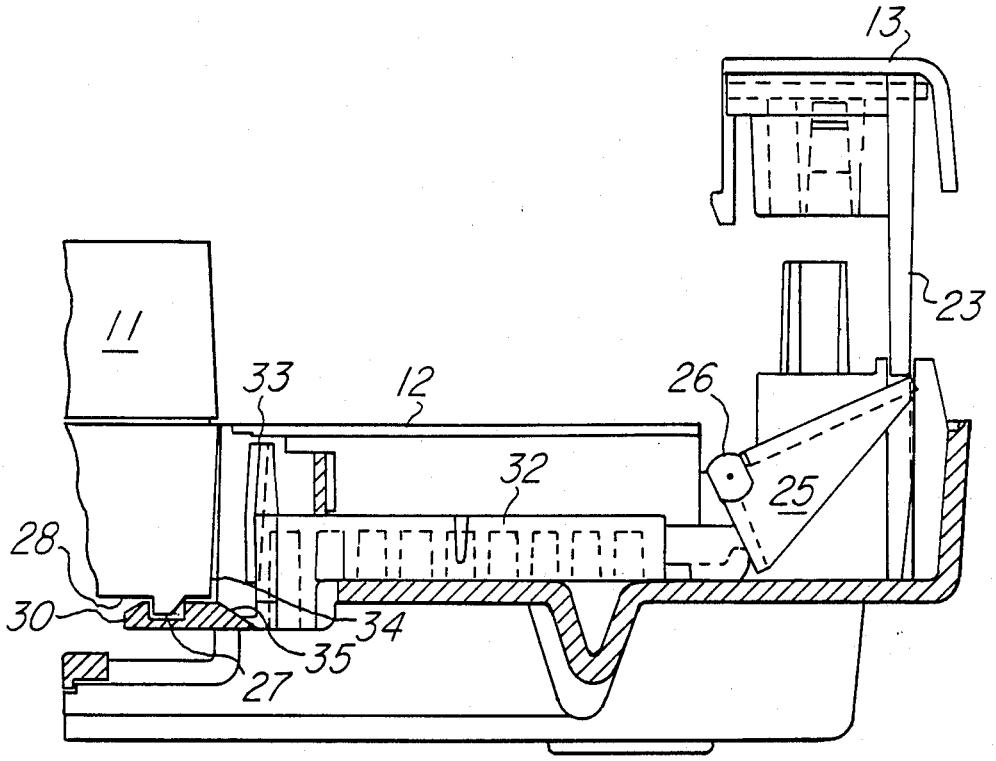
FIG. 5a is a schematic diagram of the latching mechanism of this invention, before activation.

FIG. 5*a* illustrates the mechanical latching mechanism when terminal 11 is locked in place with printer module 12. Latch 30 is shown engaging latch bar 27. Ejector button 13 has ejector pin 23 connected which engages bell crank 25. Bell crank 25 pivots around pivot point 26 and engages ejector bar 32. Contact plate 33 is connected to ejector bar 32.

Figure 5B:
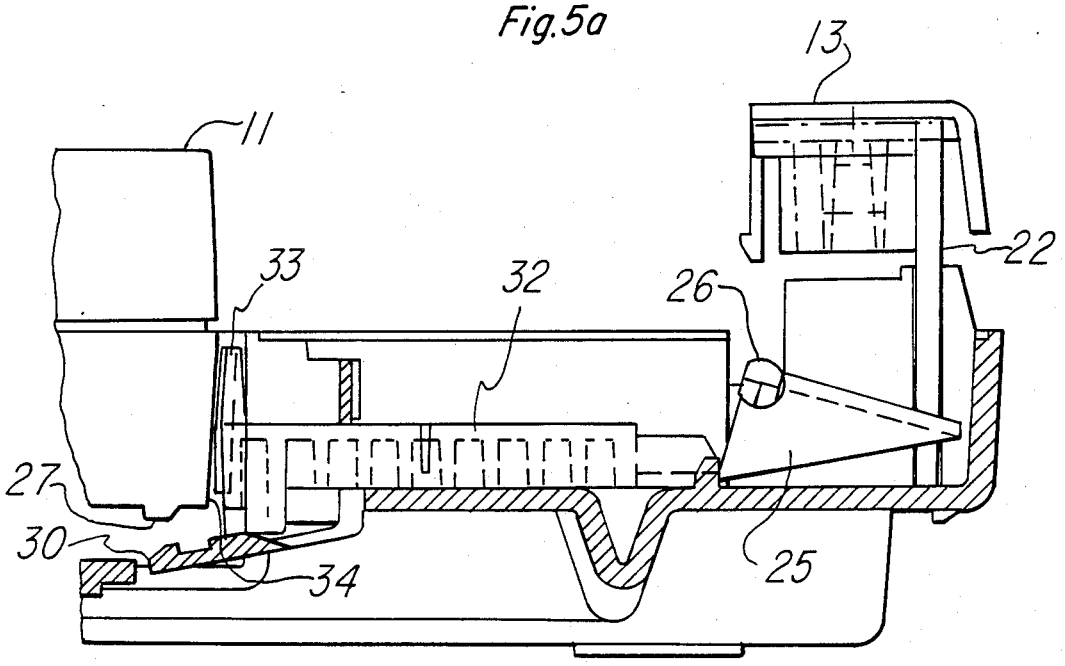
FIG. 5b is a schematic diagram of the latching mechanism of this invention after having been activated.

FIG. 5*b* illustrates the mechanical latching mechanism after activation. It can be seen that ejector pin 23 has engaged bell crank 25, sliding ejector bar 32 to the left. Ejector bar 32 has ridden up the sloped surface of latch 30, disengaging latch 30 and forcing contact plate 33 against surface 34 of terminal 11.

MODE OF OPERATION OF THE INVENTION

To cause terminal 11 to lock in position with printer module 12, terminal 11 is placed on extension 15 (FIG. 2), the placement causing nesting of curved surfaces 19 and 21 with curved path 18, resulting in position of the rails 41–44. Moving terminal 11 toward printer module 12 causes rails 43 and 44 to slide in channel 17, and rails 41 and 42 to slide in channel 16. This arrangement of mating surfaces results in positive, self alignment between terminal 11 and printer module 12. Electrical connector 20 is then very well aligned and connection between male half 20 and female half (not shown) is readily accomplished.

The mechanical latching is accomplished as indicated in FIG. 5*a* where latch bar 27 of terminal 11 engages latch 30 of printer module 12.

To disengage the terminal and printer module, ejector button 13, as shown in FIG. 5*b*, is depressed, causing ejector pin 23 to contact bell crank 25 which pivots around pivot point 26 and engages ejector bar 32. Contact plate 33 rides up the slope 35 of latch 30, forcing the latch to disengage and also pushing against face 34 (see FIG. 3) of terminal 12, thus causing a mechanical and electrical separation.

The connection mechanism shown in this preferred embodiment is accomplished through the use of well known materials and components. However, it is intended that the invention be limited only by the appended claims.

I claim:

1. A portable data handling/data entry system comprising:

(a) an electronic data handling module;

(b) an electro-mechanical , data entry module; and (c) means to releasably couple said modules together, said means including:

(d) a latch bar extending from one of said modules and latching means secured to the other of said modules for releasably latching said latch bar, said latching means including:

(e) a latch for mating with said latch bar;

(f) ejector bar means movable to simultaneously disengage said latch from said latch bar and urge said one of said modules away from said other of said modules; and (g) means to move said ejector bar means to simultaneously disengage said latch from said latch bar and urge said one of said modules, said ejector bar means includes an ejector bar and a contact plate secured to said ejector bar, said contact plate urging said one of said modules away from said other of said modules away from said other of said modules.

2. The assembly of claim 1, further including a first coupling means including a first electrical connector secured to one of said modules and a second coupling means including a second electrical connector, matable with said first electrical connector, secured to said other of said modules.

3. The assembly of claim 2 wherein the first coupling means further comprises at least one rail.

4. The assembly of claim 3 wherein the second coupling means comprises a member having at least one channel for slidably receiving the rail, to ensure self aligning travel of the electronic data handling module with respect to the electro-mechanical data entry module for electrically coupling the first and second electrical connector means.

5. The assembly of claim 2 wherein the electronic data handling module comprises an electronic terminal including a bottom housing, the bottom housing forming the first coupling means.

6. The assembly of claim 5 wherein the electromechanical data entry module comprises a keyboard.

7. The assembly of claim 5 wherein the electromechanical module comprises a thermal printer.

8. The assembly of claim 5 wherein the electromechanical module comprises an ink jet printer.

9. The assembly of claim 1 wherein said means to move includes a ejector button means and a bell crank rotatable about a pivot and rotated by operation of said ejector button means to move said ejector bar means to simultaneously disengage said latch from said latch bar and urge said one said modules away from said other of said modules.

10. The assembly of claim 1 wherein said latch includes a sloped surface, said ejector bar means movable along said sloped surface to disengage said latch and said latch bar.

11. The assembly of claim 14 wherein said latch includes a sloped surface, said ejector bar means movable along said sloped surface to disengage said latch and said latch bar.

12. The assembly of claim 1, further including a first coupling means including a first electrical connector secured to one of said modules and a second coupling means including a second electrical connector, matable with said first electrical connector, secured to said other of said modules.

13. The assembly of claim 9, further including a first coupling means including a first electrical connector secured to one of said modules and a second coupling means including a second electrical connector, matable with said first electrical connector, secured to said other of said modules.

14. The assembly of claim 10, further including a first coupling means including a first electrical connector secured to one of said modules and a second coupling means including a second electrical connector, matable with said first electrical connector, secured to said other of said modules.

15. The assembly of claim 11, further including a first coupling means including a first electrical connector secured to one of said modules and a second coupling means including a second electrical connector, matable with said first electrical connector, secured to said other of said modules.

* * * * *